United States Patent [19]

Nelson

[11] 4,207,925

[45] Jun. 17, 1980

[54] REVERSIBLE BAFFLE PLATE

[75] Inventor: Paul M. Nelson, Houston, Tex.

[73] Assignee: Wilson Industries, Inc., Houston, Tex.

[21] Appl. No.: 849,250

[22] Filed: Nov. 7, 1977

[51] Int. Cl.[2] ..... F15D 1/02

[52] U.S. Cl. ..... 138/44; 138/115; 33/304; 175/44

[58] Field of Search ..... 138/40, 44, 108, 115; 175/44, 45, 46, 48, 50; 33/304

[56] References Cited

U.S. PATENT DOCUMENTS

| | | | |
|---|---|---|---|
| Re. 16,980 | 5/1928 | Vaugh et al. | 138/40 X |
| 1,059,626 | 4/1913 | McAllister | 138/115 X |
| 1,739,161 | 12/1929 | McKee | 138/44 X |
| 1,953,110 | 4/1934 | Holtane | 138/44 |
| 2,095,899 | 10/1937 | Yancey | 138/44 X |
| 2,224,472 | 12/1940 | Chandler | 138/44 X |
| 2,294,162 | 8/1942 | Dobscha | 138/115 X |
| 2,651,199 | 9/1953 | Collins et al. | 33/304 X |
| 2,768,840 | 10/1956 | Coberly | 138/115 X |
| 2,820,610 | 1/1958 | Martinez | 175/44 |
| 3,059,707 | 10/1962 | Frisby | 175/44 |
| 3,229,723 | 1/1966 | Janton | 138/44 |
| 3,774,645 | 11/1973 | Pompa | 138/44 |

FOREIGN PATENT DOCUMENTS

| | | | |
|---|---|---|---|
| 2056557 | 5/1972 | Fed. Rep. of Germany | 138/44 |
| 473432 | 5/1953 | Italy | 138/44 |
| 5812 | of 1912 | United Kingdom | 138/115 |

*Primary Examiner*—Harry N. Haroian
*Assistant Examiner*—James E. Bryant, III
*Attorney, Agent, or Firm*—Arnold, White & Durkee

[57] ABSTRACT

A reversible baffle plate for receiving and supporting a bottom hole survey apparatus on the interior of a directional drilling string is characterized by concentrically disposed inner and outer members supported one from the other by a plurality of webs. The webs cooperate with the inner and outer members to define a plurality of flow passages through the baffle plate. The first and second axial ends of the inner tubular member are each adapted to receive and support the lowermost axial end of a bottom hole survey apparatus.

1 Claim, 2 Drawing Figures

REVERSIBLE BAFFLE PLATE

BACKGROUND OF THE INVENTION

1. Field of the Invention

This invention relates to a reversibly mountable baffle plate for supporting a bottom hole survey apparatus within a directional drilling string.

2. Description of the Prior Art

In directional drilling environments associated with the exploration and production of hydrocarbons it is often necessary to ascertain accurately the orientation of a bore being generated through formations of the earth's surface with respect to a predetermined datum. Simultaneously, it is desirable to provide information concerning the vertical declination of the bore hole from true vertical. Also, in some instances, it may be desirable to ascertain the direction of the drilling bit generating the bore. To accomplish these three aforementioned purposes the prior art inserts into the bore being generated a suitable survey apparatus such as that disclosed and claimed in the co-pending application Ser. No. 821,461, filed Aug. 3, 1977, now U.S. Pat. No. 4,141,153, and assigned to the assignee of the present invention. With the bottom hole survey apparatus disposed within the directional drilling string the orientation of the drilling string with respect to the predetermined datum, as well as the vertical declination and bit orientation, may be determined.

Typically, in operation, the bottom hole survey apparatus may be pumped down or lowered by a wire line through the interior of the directional drilling string until a mule shoe element usually provided on the lowermost axial end of the survey apparatus receives and engages a radially inwardly directed pin. The inwardly directed pin is secured to the directional drilling string in a predetermined relationship with the drill bit. With the receipt of the pin in the slot of the mule shoe, the instrumentation connected within the bottom hole survey apparatus is placed in a predetermined axial alignment with the drill bit such that an accurate determination of the direction of the bore generated by the bit may be obtained. Arrangements as that just described are typically utilized in connection with bottom hole survey apparatus wherein the instrumentation includes photographic equipment operable to provide a photographic print illustrating the orientation of a plum bob with respect to a transparent disc having an array of concentrically disposed lines scribed thereon to indicate the vertical declination of the bore hole.

Alternatively, in those cases where the vertical declination of the bore is desired but where the directional orientation of the bit is not required, it is common practice in the art to replace the mule shoe with a suitable landing sub and to dispose therein a member known in the art as a baffle landing plate. The baffle plate is disposed in the drill string prior to the insertion of the drill string into the bore hole to thereby form a false bridge or false bottom onto which the instrument package is landed. It is again noted that the baffle plate is disposed in place of the mule shoe sub, and inserted in a manner so as to present only a minimal impedence to the flow of well fluid. The baffle plate generally includes an outer ring secured by an array of webs to a concentrically disposed inner member. The inner member is spaced axially with respect to the outer ring and supported in position by the array of webs. In cross-section, the orientation of the inner ring (when supported by the webs) with respect to the outer ring defines a substantially frusto-conical arrangement. In operation, the narrow diameter of the frustum is disposed toward the surface. The webs define a plurality of openings which permit well fluid to flow through the directional drilling string while the lower end of the bottom hole survey apparatus is received within the opening defined in the inner ring. It has been observed that only if the baffle plate is disposed within the directional drilling string such that the inner ring is proximal to the surface will flow be permitted through the openings provided by the webs when the directional drilling element is associated with the baffle plate and supported thereby. If this described arrangement is reversed, the combination of the survey apparatus and the baffle plate act to undesirably throttle the flow. Accordingly, it is necessary to precisely and accurately insert the baffle plate into those sections of drill pipe disposed next-above the directional drilling elements prior to insertion of the directional drilling element into the well bore. As noted, the consequence of improper insertion of the baffle plate within the drill string is the potential inhabition or blockage of the flow of well drilling fluid during that period of time when the lowermost axial end of the survey apparatus is received in and supported by the baffle plate.

It would, accordingly, be advantageous to provide a baffle plate for receiving and supporting the lowermost axial end of a bottom hole survey apparatus within the interior of a directional drilling string such that the flow of drilling fluid is neither inhibited nor blocked when the bottom hole survey apparatus is received in and supported thereby. It would be a further advantage to provide a baffle plate for supporting the lower axial end of a bottom hole survey apparatus that may be interchangeably mounted between adjacent drill pipe sections without regard to the orientation of the baffle plate as the drill string is assembled.

SUMMARY OF THE INVENTION

This invention relates to a reversible baffle plate for receiving and supporting a bottom hole survey apparatus within a directional drilling string. The baffle plate according to this invention comprises an inner, elongated, hollow tubular member having first and second axial ends thereon, each axial end being sized to receive the end of the lowermost axial element of a bottom hole survey apparatus. Concentrically disposed about the inner tubular member is an outer ring disposed substantially equidistant the first and second axial ends of the tubular member. A plurality of webs disposed between the inner and outer members supports those members in their defined assembled relationship and cooperates therewith to define a plurality of flow passages therebetween. A baffle plate in accordance with this invention is insertable and receivable with and between adjacent drill pipe sections in the directional drilling string without regard as to whether the first or second end of the inner tubular member is disposed proximal to the surface.

BRIEF DESCRIPTION OF THE DRAWINGS

The invention will be more fully understood from the following detailed description thereof, taken in connection with the accompanying drawings, which form a part of this specification and in which.

DESCRIPTION OF THE PREFERRED EMBODIMENT

Figure 1:
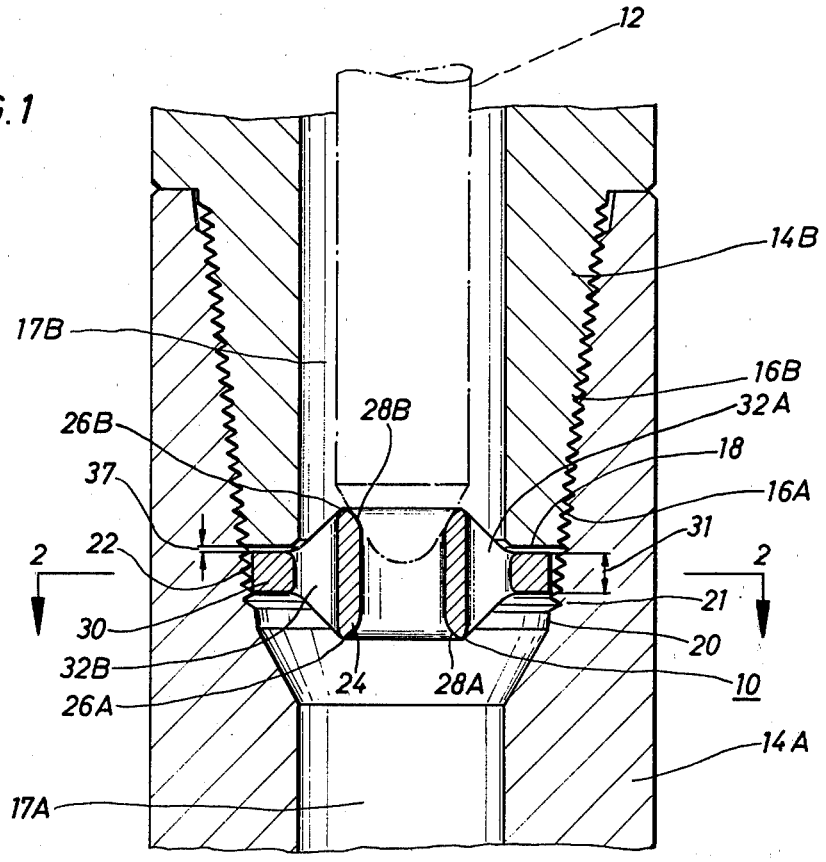
FIG. 1 is an elevational view entirely in section of a reversible baffle plate for receiving and supporting a bottom hole survey apparatus within a directional drilling string in accordance with the teachings of this invention; and, FIG. 2 is a view taken along section lines 2—2 in FIG. 1.
Figure 2:
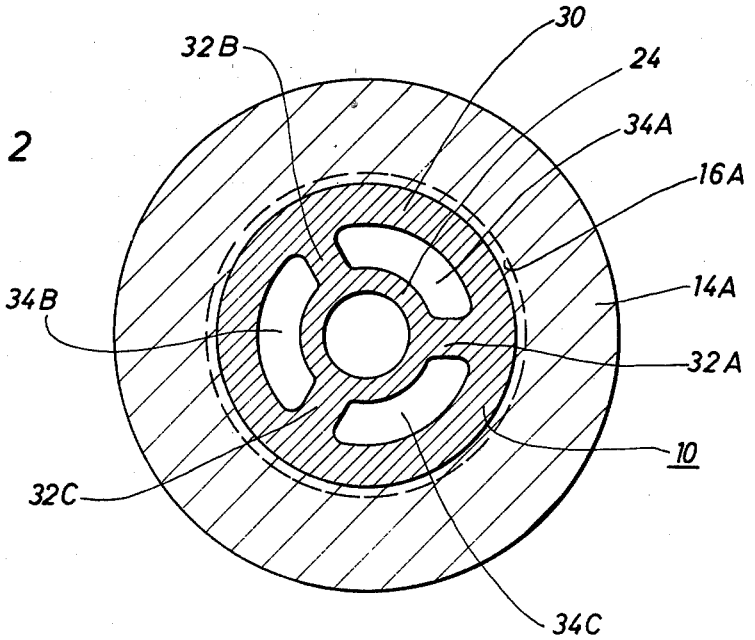

Throughout the following description similar reference numerals refer to similar elements in all figures of the drawings.

With reference to the figures a reversible baffle plate generally indicated by reference number 10 for receiving and supporting the end of the lowermost axial element 12 of a bottom hole survey apparatus is illustrated in its operating environment as disposed between threaded tubular drill pipe sections 14A and 14B. The pipe sections 14A and 14B are connected to form a part of a directional drilling arrangement, with the pipe section 14A being attached to the directional drill string.

As seen in FIG. 1, the lowermost tubular member 14A disposes a threaded box connection 16A sized to receive in threaded engagement the externally threaded pin projection 16B disposed on the lowermost axial end of the second tubular member 14B. The interior diameters of the tubular members 14A and 14B register to define a hollow tubular passage 17 extending substantially through the interior of the drilling string. Between the axial end 18 of the pin projection on the upper pipe section 14B and a shoulder 20 defined adjacent the axial end 21 of the threads 16A on the pipe section 14A a substantially annular recess 22 is defined.

The reversible baffle plate 10 embodying the teachings of this invention includes an inner elongated tubular member 24 having a first and a second axial end 26A and 26B respectively thereon. Each of the axial ends 26A and 26B are rounded or otherwise suitably tapered so as to provide a landing surface 28A and 28B.

Spaced outwardly and concentrically with respect to the inner tubular member 24 is a ring member 30 having a predetermined height dimension 31. The ring member 30 is disposed substantially equidistant between the first and second axial ends 26A and 26B of the inner tubular member 24. A plurality of webs 32A, 32B and 32C cooperates with the inner tubular member 24 and the outer ring 30 to define a plurality of flow passages 34A, 34B and 34C.

During make-up of the directional drilling string of which the pipe sections 14A and 14B are constituent elements, the outer ring 30 is received within the annular region 22 defined between the lower axial end 18 of the upper pin projection of the upper pipe section 14B and the portion 20 of the lower pipe section 14A. The outer diameter of the ring 30 is selected such that the baffle plate rests against a predetermined location on the inner diameter of the threaded box connection 16A. In this manner, the axial location of the baffle plate with respect to the pipe section 14B is controlled. Further, the height dimension 31 of the baffle plate is selected such that, with the section 14A and 14B threaded together, a narrow axial clearance 37 is defined between the ring 30 and the lower axial end of the pin 16B. Precision casting the baffle plate provides the selected dimensions without the necessity of machining. It may be appreciated that due to the location and disposition of the outer ring 30 substantially equidistant between the first and second axial ends 26A and 26B, respectively, of the inner tubular member 24, a baffle plate 10 in accordance with the teachings of this invention may be reversibly inserted into the annular region 22 without regard as to which of the axial ends 26 of the inner member 24 is disposed toward the surface. Accordingly, the baffle plate 10 may be easily inserted into the drill string.

It may be also appreciated that, in operation, with the bottom hole survey apparatus 12 received within the appropriate axial end 26 of the inner tubular member 24, well fluid may flow past the baffle plate 10 from the upper passage 17B toward the lower passage 17A through the flow passages 34 without inhibition or blockage effects.

In accordance with the teachings of this invention the baffle plate 10 may be advantageously formed by casting or forging from suitable material, as steel, bronze, aluminum or hard plastic. The outer diametrical dimension of the outer ring 30 may be appropriately sized to be conveniently received within any of the standard interior diameters of the pipe sections used in the directional drilling industry.

Having described a preferred embodiment of the invention those skilled in the art may effect numerous modifications thereto in view of the foregoing description. It is appreciated, however, that such modifications remain within the scope of this invention as defined by the appended claim.

What is claimed is:

1. A baffle landing plate adapted for reversible disposition within an annular recess of a predetermined axial dimension defined between adjacent sections of drill pipe and adapted for receiving and supporting a bottom hole survey apparatus comprising:

an inner elongated tubular member of a predetermined axial dimension having first and second axial ends thereon, each axial end being sized and shaped to define landing surfaces to receive the lowermost axial end of a bottom hole survey apparatus therein;

an outer ring disposed concentrically about said inner tubular member at a location thereon substantially equidistant said first and second axial ends thereof, said outer ring having an axial dimension less than the dimension of said tubular member and being receivable within the annular recess between adjacent sections of drill pipe; and, a plurality of webs disposed between said inner tubular member and said outer ring for supporting said members in said concentrically spaced relationship, said webs cooperating with said inner tubular member and said outer ring to define a plurality of flow passages therebetween.

* * * * *